US005416301A

United States Patent [19]

Aoshima

[11] Patent Number: 5,416,301

[45] Date of Patent: May 16, 1995

[54] COOKING APPLIANCE WITH AUTOMATIC POWER-OFF SWITCH

[75] Inventor: Terutaka Aoshima, Aichi, Japan

[73] Assignee: Kabushiki Kaisha Toshiba, Kanagawa, Japan

[21] Appl. No.: 69,418

[22] Filed: Jun. 1, 1993

[30] Foreign Application Priority Data

Jun. 3, 1992 [JP] Japan ..... 4-142600

[51] Int. Cl.[6] ..... H05B 1/02

[52] U.S. Cl. ..... 219/506; 219/720; 219/492; 219/487; 340/640

[58] Field of Search ..... 219/492, 494, 497, 499, 219/501, 506, 505, 487, 720; 340/584, 640

[56] References Cited

U.S. PATENT DOCUMENTS

| | | | |
|---|---|---|---|
| 4,222,037 | 9/1980 | Schaap et al. | 340/309.1 |
| 4,393,300 | 7/1983 | Proctor | 219/497 |
| 4,467,184 | 8/1984 | Loessel | 219/506 |
| 5,160,831 | 11/1992 | Thaler et al. | 219/506 |
| 5,243,172 | 9/1993 | Hazan et al. | 219/450 |

FOREIGN PATENT DOCUMENTS 61-23611 2/1986 Japan .

*Primary Examiner*—Mark H. Paschall
*Attorney, Agent, or Firm*—Cushman, Darby & Cushman

[57] ABSTRACT

A cooking appliance has a heater for cooking, and a switch which generating an operational signal. The cooking appliance automatically turns off the heater a predetermined time after a last pressed switch, i.e., automatic power off function. A caution lamp indicates that the heater will automatically be turned off a minute prior to the automatic power off function.

10 Claims, 3 Drawing Sheets

COOKING APPLIANCE WITH AUTOMATIC POWER-OFF SWITCH

BACKGROUND OF THE INVENTION

The present invention relates to a cooking appliance having an automatic power off function which automatically switches off a heater a predetermined period after a last operation.

Prior cooking appliances which use plural halogen lamps as a heater have an automatic power off function. The cooking appliance comprises a rectangular box-shaped outer case and a heat resistant glass plate fixed on a top of the outer case. The halogen unit, which is positioned within the outer case and under the glass plate, heats a pan and the like which is placed on the glass plate. The operator can turn on and off the halogen unit and adjust the power of the halogen unit by operating keys of an operation panel. The automatic power off function automatically turns off the halogen unit when the halogen unit is on for a predetermined time, for instance one hour, during which the operator does not operate the key.

As a result, even if the operator forgets to turn off the halogen unit, the unit is safe and does not waste energy because the halogen unit is automatically turned off in the certain time. When the halogen unit is automatically turned off, the cooking appliance informs the operator that it has been turned off by sounding a buzzer for a short period.

The cooking appliance works for plural kinds of cooking, for example, a short term cooking and a long term cooking such as a stew which takes more than one hour. When the operator cooks the stew requiring a longer time than the automatic power off function, the operator must operate the key before the certain period elapses or turn on the halogen unit again after the halogen unit is turned off.

However, the buzzer rings such a short time that the operator might fail to hear the buzzer and unaware that the halogen unit had been turned off. Therefore, the cooking of the stew is interrupted in the midst of its cooking. Also, since it is difficult for the operator to recognize that the halogen unit is turned off by the automatic power off function, the operator might misrecognize it as a breakdown or a malfunction.

SUMMARY OF THE INVENTION

It is an object of the present invention to provide a cooking appliance with an automatic power off function which can efficiently inform the operator that the automatic power off function would be performed.

In order to achieve the above object of the present invention, there is provided a cooking appliance comprising:

a) heating means for cooking;

b) a switch for generating an operational signal;

c) display means for indicating that the heating means would be automatically turned off; and d) control means for turning off the heating means in a predetermined time after a last signal which is generated by the switch is input thereto, and for operating the display means in advance of turning off the heating means.

DETAILED DESCRIPTION OF THE PREFERRED EMBODIMENT

Figure 2:
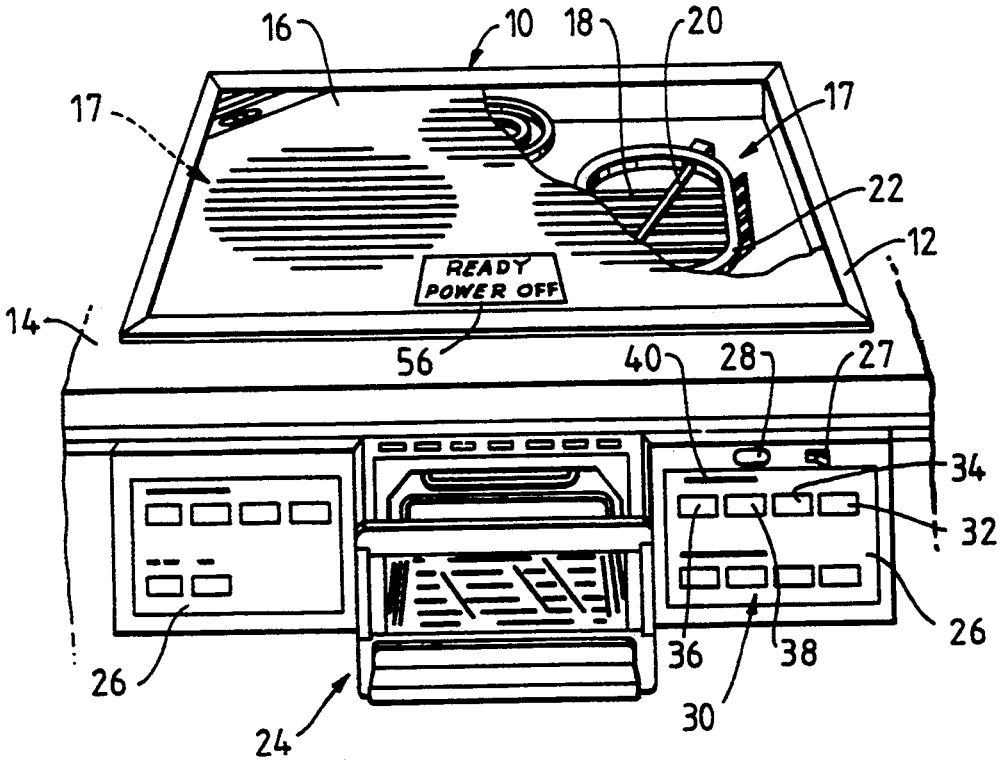
FIG. 2 is a perspective view of the cooking appliance.

An embodiment of the present invention will now be described as follows. With reference to FIG. 2, a cooking appliance 10 has a rectangular outer case 12 which is installed into an opening of a cooking table 14. A translucent top plate 16 made of, for instance, crystallized glass is provided on a top surface of outer case 12. Two heater units 17 are located on the left and right of outer case 12 and on an inner surface of top plate 16. Each heater unit 17 comprises four halogen lamps 18, a temperature limiter 20, and a heat resisting cup-shaped support 22 which supports both the halogen lamps and the temperature limiter. Each heater unit 17 (halogen lamps 18) heats a pan and the like which is placed on top plate 16. A roaster 24 is positioned in a center of a lower part of outer case 12. In the front of outer case 12, an operation panel 26 is provided to left and right of roaster 24. A power switch 27, a power display lamp 28, and each switch 30 in accordance with both each heater unit 17 and roaster 24 are located on operation panel 26.

Figure 3:
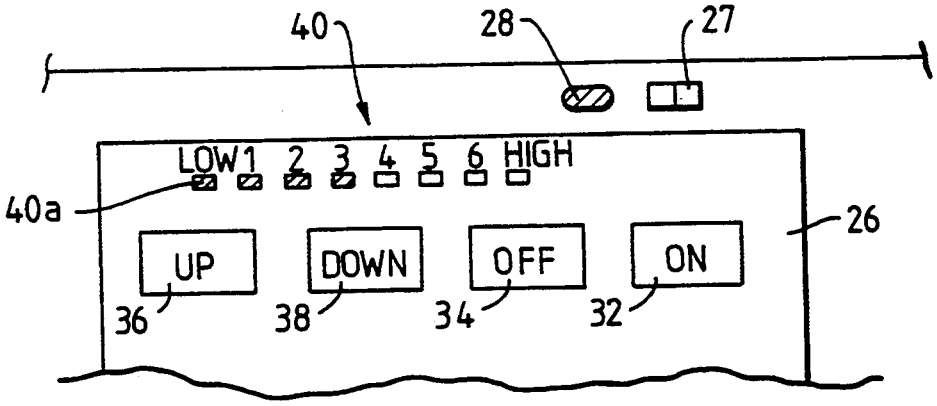
FIG. 3 is a plan view of an operation panel of the cooking appliance.

FIG. 3 indicates a part of operation panel 26 which corresponds to right-hand heater unit 17. An "ON" key 32 which actuates heater unit 17 and an "OFF" key 34 which deactivates heater unit 17 are positioned on the part of operation panel 26. Also, an "UP" key 36 which increases power of heater unit 17 and "DOWN" key 38 which decreases power of the heater unit are positioned there. An indicating lamp 40, which indicates an updated power level of heater unit 17, is located on the part. Indicating lamp 40 has eight segments **40*a*, such as LEDs, which are placed in a row Each "LOW" numerals "1" to "6" and "HIGH" which indicates the power level of heater unit 17 is arranged above each segment 40*a* in sequence from left. That is, user can adjust power level of heater unit 17 to one of eight levels. Substantial same switches corresponding to the left-hand heater unit 17 and roaster 24 are provided on operation panel 26**.

Figure 4:
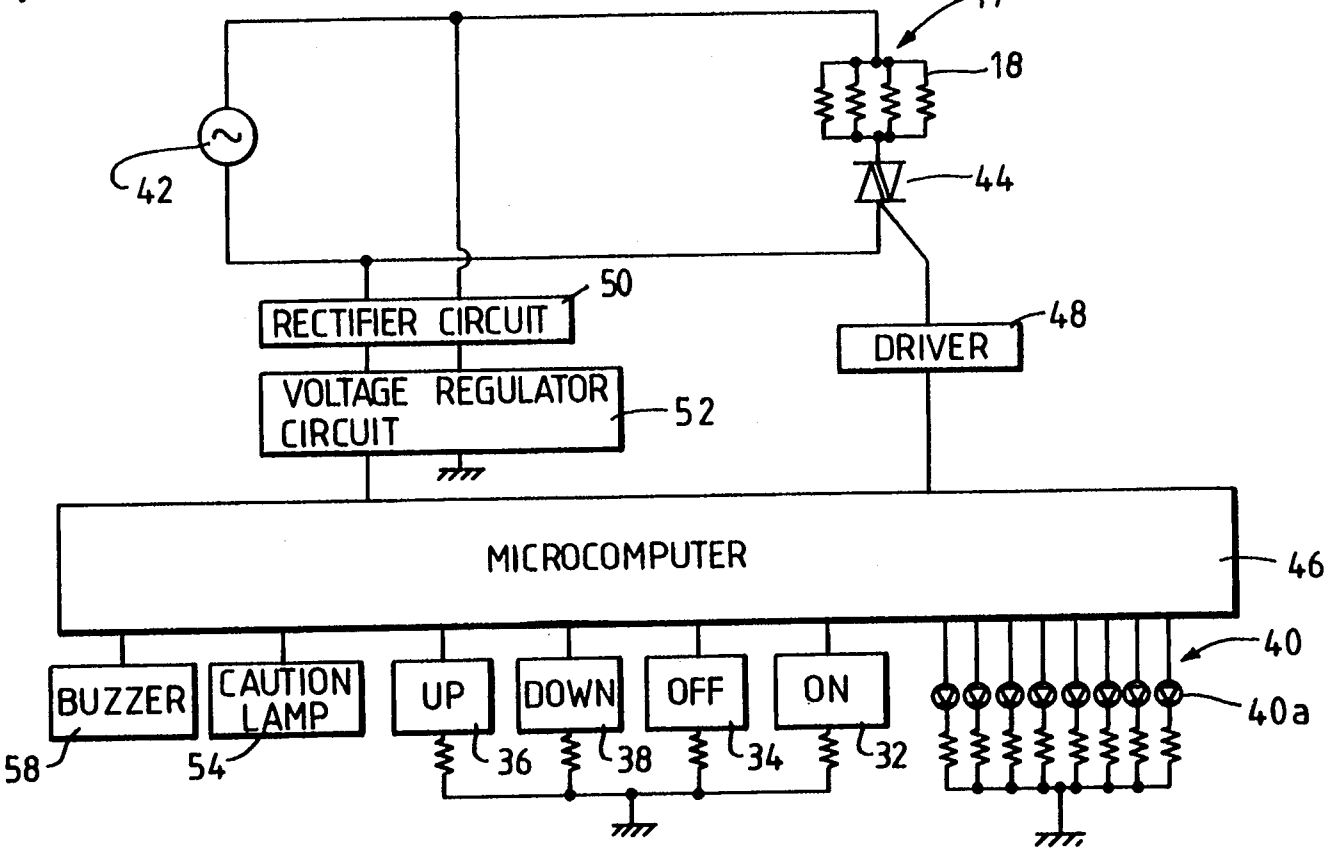
FIG. 4 is an electrical arrangement of the cooking appliance.

FIG. 4 shows the electrical arrangement of cooking appliance 10, omitting those parts related to left-hand heater unit 17 and roaster 24. Heater unit 17 (halogen lamps 18) is connected to AC power source 42 through a triac 44. A gate of triac 44 is coupled to a microcomputer 46 through a driver 48. Microcomputer 46 is connected to AC power source 42 through a rectifier circuit 50 and a voltage regulator circuit 52. "ON" key 32, "OFF" key 34, "UP" key 36, "DOWN" key 38, and segments **40*a* are connected in parallel between microcomputer 46 and the ground through resistances. A caution lamp 54, is a literal indicator which informs the operator that heater unit 17 will be imminently turned off, is connected to microcomputer 46. A cover plate 56, on which "READY POWER ON" is printed, covers caution lamp 54 and is located on the middle of top plate 16 (see FIG. 2). Therefore, when caution lamp 54 is energized, since cover plate 56 is lighted, operator can understand the word printed on cover plate 56. A buzzer 58, which informs the operator that heater unit 17 will be turned off, together with caution lamp 54, is connected to microcomputer 46. Buzzer 58 is located in outer case 12**.

As will be clear from the flow chart which is described later, buzzer 58 rings several times at a set time such as one minute before the automatic power off function is operated (before heater unit 17 is automatically turned off). Caution lamp 54 continues flashing from one minute before the automatic power off function is operated until the automatic power off function has completed or is postponed.

When microcomputer 46 receives signals from keys 32 to 38, the microcomputer controls heating power of heater unit 17 based on these signals by performing ON/OFF control (phase control) of triac 44. Also, microcomputer 46 lights segments 40*a* based on the signals from "UP" key 36 and "DOWN" key 38 so that the signals indicate the power level of heater unit 17 (a certain number from the left are lit).

Microcomputer 46 is programmed to automatically execute the automatic power off function. This automatic power off function automatically turns off heater unit 17 when a specified amount of time, such as one hour, has elapsed from the time of the last key operation of operation panel 26, when there has been no following key operation and heater unit 17 is on, in order to prevent the operator forgetting to turn off heater unit 17.

Figure 1:
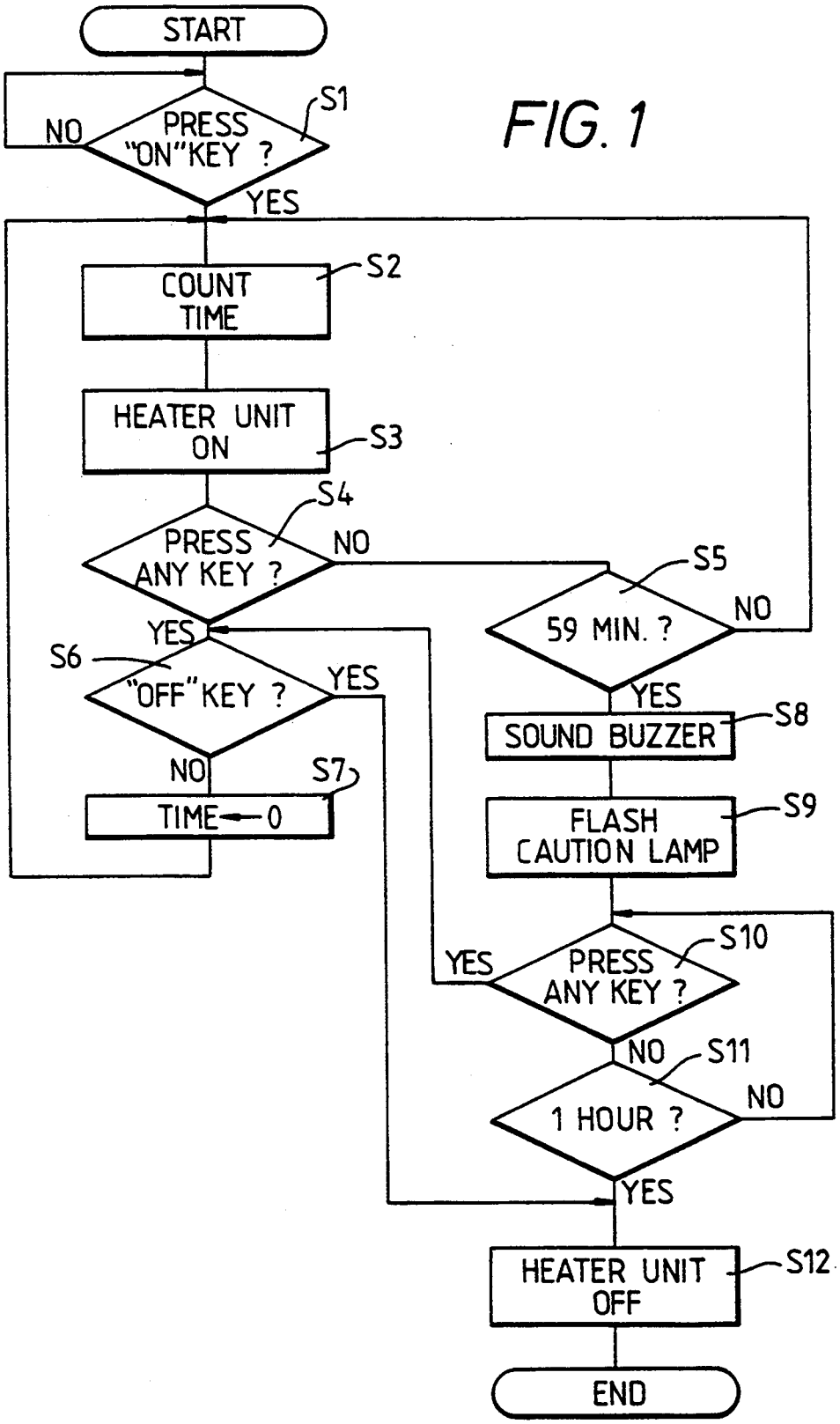
FIG. 1 is a flow chart illustrating operation of a cooking appliance according to the present invention.

Operation of the above construction will be described with reference to FIG. 1. When operator presses power switch 27, power display lamp 28 is lit. Operator puts a pan on top plate 16, for example for a portion above right-hand heater unit 17. Operator selects the heating power of heater unit 17 by pressing "UP" key 36 and/or "DOWN" key 38 during watching indicating lamp 40. For instance, when heating power is set at level three, four segments 40*a* from the left side shine as shown in FIG. 3 (for convenience, shining segments 40*a* are shown by hatching). Operator presses "ON" key 32 so that heater unit 17 starts heating.

When "ON" key 32 depression is detected at step S1, microcomputer 46 starts counting time of a timer toward the predetermined automatic power off time, for instance one hour (step S2). Heater unit 17 starts heating on the basis of a signal from microcomputer 46 through triac 44 (step S3). Microcomputer 46 always monitors whether a following key is operated (step S4). If not, microcomputer 46 continues monitoring until the time of the timer reaches 59 minutes, that is one minute before the automatic power off function being performed (step S5). If operator finishes cooking using "OFF" key 34 or changes the power level, the result is "YES" at step S4 and flow progresses to a next step S6, which determines whether "OFF" key 34 has been pressed. If so, heater unit 17 is turned off in step S12. If not, the time of the timer is reset to zero, and flow returns back to step S2.

When operator cooks for more than one hour, such as a stew, or forgets to press "OFF" key 34 after the cooking is completed, step S4 detects a condition where no following keys have been pressed. If that condition continues until one minute before the automatic power off function is performed, the result in step S5 becomes "YES" and buzzer 58 sounds several times. At the same time, caution lamp 54 starts flashing, and continues to flash to visually inform the operator that heater unit 17 will be turned off within one minute (step S9) .

If following key, such as "ON" key 32, "UP" key 36, or "DOWN" key 38, is pressed within one minute, that is, operator wants to continue cooking, microcomputer 46 will determine "YES" at step S10. Flow then returns back to step S6 and buzzer 58 stops sounding. Of course, when "OFF" key 34 is pressed also, flow enters step S6, and the result becomes "YES" at step S6 and heater unit 17 is turned off. When following key is not pressed within one minute, the result becomes "NO" at step S10, and flow progresses to step S11. At step S11, microcomputer 46 determines whether the time exceeds one hour, that is, automatic power off time, If so, heater unit 17 is turned off at step S12. If not, flow repeats step S10 and step S11.

According to the embodiment, since buzzer 58 sounds and caution lamp 54 continues flashing one minute before the automatic power off function is performed, the operator can readily recognize that the automatic power off function would be performed. Therefore, the operator can continue cooking such as stew without interruption of heating due to pressing a key.

The operation of caution lamp 54 can be changed so that, for instance, caution lamp 54 is turned on continuously, and an interval of flashing becomes short gradually.

Moreover, instead of providing caution lamp 54 which is located on top plate 16, indicating lamp 40 may be turned on and off repeatedly so that it informs operator that heater unit 17 will be turned off. In this case, since the display of indicating lamp 40 is changed to flashing from its previous state of constantly on, it visually urges operator to press a key on operation panel 26. Since an extra lamp such as caution lamp 54 is not needed, the construction can be made simpler and less costly.

Further, instead of providing caution lamp 54, halogen lamps 18 of heater unit 17 may be turned on and off repeatedly to inform the operator that the automatic power off function would be performed. Since an extra lamp such as caution lamp 54 is not needed, the construction can be made simpler and less costly. The very noticeable display using halogen lamps 18 promotes the caution more effectively.

Moreover, time of automatic power off function is not limited to one hour, and time of lighting caution lamp 54 is also limited to one minute before heater units 17 would be turned off due to the automatic power off function. The time of lighting caution lamp 54 may be changed in accordance with the power level of heater unit 17. Heater unit 17 could be any kind of heater—it does not need to include halogen lamps.

Although only a single preferred embodiment has been described in detail above, those skilled in the art will certainly understand that many modifications are possible in the preferred embodiment without departing from the teaching thereof.

All such modifications are intended to be encompassed within the following claims.

What is claimed is:

1. A cooking appliance comprising:

a) heating means;

b) a switch for generating an operational signal to control said heating means;

c) display means for indicating that the heating means will imminently be automatically turned off; and d) control means, receiving the operational signal, for turning off the heating means a predetermined time after a last operational signal generated by the switch is input thereto, and for operating the display means before turning off the heating means.

2. A cooking appliance according to claim 1, wherein the display means indicates continuously until the heating means is turned off.

3. A cooking appliance according to claim 1, wherein the display means includes an indicator for visually displaying a message to an operator that the heating means will imminently be turned off.

4. A cooking appliance according to claim 1, wherein the display means displays a specific mode which is not used during normal cooking for indicating that the heating means will imminently be automatically turned off.

5. A cooking appliance according to claim 4, wherein the display means includes a lamp for indicating that the heating means is powered, the lamp being turned off intermittently to indicate the automatic turn off of the oven is to be performed imminently.

6. A cooking appliance as in claim 1 wherein the heating means includes a lamp and the display means includes means for controlling the lamp to flash, thereby indicating the automatic turn off of the oven which is to be performed imminently.

7. A cooking appliance comprising:

a) means, having a lamp, for cooking, and for indicating that the cooking means will imminently be automatically turned off;

b) a switch for generating an operational signal to control the cooking means; and c) control means, receiving the operational signal, for turning off the cooking means a predetermined time after a last signal is generated by the switch, and for indicating an imminent turn off by turning off the cooking means intermittently before turning off the cooking means completely.

8. A cooking appliance according to claim 7, wherein the lamp includes a halogen lamp.

9. A cooking appliance comprising:

a) heating means, having a halogen lamp, for cooking;

b) a switch for generating an operational signal to control the heating means;

c) display means, having an indicator which indicates that the heating means will be automatically turned off, for displaying the indicator; and d) control means for turning off the heating means a predetermined time after a last signal which is generated by the switch is input thereto, and for operating the display means continuously until the heating means turns off before turning off the heating means.

10. An automatic turn off cooking appliance comprising:

a) heating means having at least a first area with a first surface for accepting an object to be heated and a second area including a heating device which produces heat to said first area and to said first surface when energized;

b) a control structure including on and off switch means for generating an energization of said heating means and heat quantity switch means for controlling an amount of heating which will be produced by said heating means, each said switch means selecting a function based on an input from a user and including an associated indicator for producing an indication of an operational status;

c) control means for detecting each time one of said switch means in said control structure is operated, for determining a time which has elapsed since a last time that any one of said switch means in said control structure is operated, for determining if said time which has elapsed is greater than a first predetermined time, or producing a warning output signal when said time is greater than said first predetermined time, for determining if any of said switch means are operated for a second predetermined time after said warning output signal is produced, and for turning off said heating means when said user does not operate any switch means for said second predetermined time after said warning output signal is produced; and d) turn off warning means, operable responsive to said warning output signal, for producing both a visual and an audible warning indicative of imminent turn off of said heating means.

* * * * *